United States Patent [19]

Ikemoto

[11] 4,088,161

[45] May 9, 1978

[54] BALLOON VENDING MACHINE

[76] Inventor: Kikuji Ikemoto, 100-27 Shin-narita, Hirono-cho, Uji-shi, Kyoto-fu, Japan

[21] Appl. No.: 738,230

[22] Filed: Nov. 2, 1976

[30] Foreign Application Priority Data

Nov. 28, 1975 Japan ..... 50-143227

[51] Int. Cl.[2] ..... B65B 43/14

[52] U.S. Cl. ..... 141/167; 141/171; 141/173; 141/176; 141/372

[58] Field of Search ..... 46/87, 90; 141/4, 114, 141/129, 135, 137, 156–162, 164–168, 171, 173–176, 181, 183, 190, 191, 231–233, 270, 279, 281, 284, 313, 314, 369, 372, 382

[56] References Cited

U.S. PATENT DOCUMENTS

| | | | |
|---|---|---|---|
| 3,380,490 | 4/1968 | Ellenberg et al. | 141/167 |
| 3,596,110 | 10/1970 | West | 141/167 X |
| 3,616,823 | 11/1971 | Iacono | 141/167 X |

*Primary Examiner*—Richard E. Aegerter
*Assistant Examiner*—Frederick R. Schmidt
*Attorney, Agent, or Firm*—Browdy and Neimark

[57] ABSTRACT

A balloon vending machine to accommodate inside a number of non-inflated balloons in advance and to offer the inflated balloons one by one upon demand. The non-inflated balloons are arranged inside in such a manner so that each balloon neck fitting with the balloon is engaged with a pair of rails, and the balloons are automatically taken out and delivered after slidingly moved along the rails and inflated with a gas. The balloon neck fittings consists of a check valve part and a sliding guide part engaging with the rails and is separated into these two parts at the time of delivery of a balloon.

8 Claims, 10 Drawing Figures

BALLOON VENDING MACHINE

FIELD OF THE INVENTION

The present invention relates to a balloon vending machine, and particularly to a machine to accommodate in advance a number of non-inflated balloons inside and to automatically take out and deliver inflated balloons one by one according to the demand by a purchaser.

BACKGROUND OF THE INVENTION

A balloon vending machine has already been suggested by U.S. Pat. No. 3,380,490. In this case, the non-inflated balloons accommodated inside are put on a long belt with a proper distance between each and they are conveyed by means of the belt. Accordingly in such case, a troublesome operation is required for fitting the balloons to the belt beforehand and besides addition of more balloons before all of them are consumed is difficult because it is possible only by exchanging the belt as the whole. Further in such machine, it is difficult for a purchaser to select a particular kind of balloon according to his taste, because the balloons are delivered in such order as arranged on a belt beforehand.

SUMMARY OF THE INVENTION

One of the objects of the present invention is to provide a balloon vending machine able to convey balloons without using a belt and to offer balloons in an easier and less costly fashion.

Another object of the present invention is to provide a balloon vending machine in which accommodation and conveying of balloons are conducted by a rail means.

A further object of the present invention is to provide a balloon vending machine in which balloons supported by the rail means are hung and conveyed by a gas supplying means to the position where the balloons are to be inflated.

Further another object of the present invention is to provide a balloon vending machine which includes balloon neck fittings consisting of a check valve part to be fitted into a balloon and to prevent the gas inside the balloon from leaking out, a sliding guide part to slidably engage with the rail means and to act as a hook means for a finger after the balloon is delivered and the string between the two parts to connect them after they are separated from each other.

One more object of the present invention is to provide a balloon vending machine in which the rail means to accommodate and convey balloons is divided into upper and lower parts, the lower part consisting of a number of rails parallelly arranged and upwardly projected on a turn table, the upper part being able to be connected with every one of the lower part rails by turning the turn table by a proper angle, so that a larger number of balloons can be accommodated and a convenient selection of a particular kind of balloon can be made.

DESCRIPTION OF PREFERRED EMBODIMENT

Figure 1:
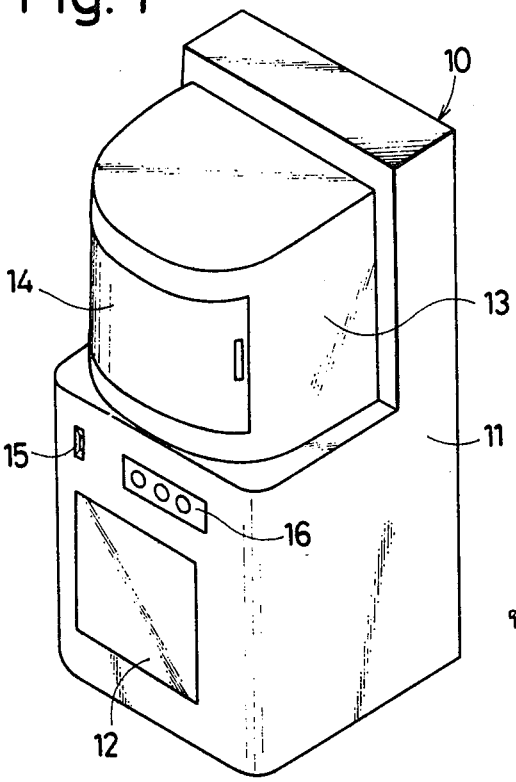
FIG. 1 is a perspective view of the appearance of an embodiment for the present invention.

A preferred embodiment of the balloon vending machine of the present invention is described hereafter referring to the drawings thereof.

As shown in FIG. 1, the balloon vending machine 10 is entirely enclosed with the cabinet 11. At a lower part of the front wall of the cabinet 11 is provided a looking glass 12 of a transparent material through whcih a purchaser can see the inside and know what kind of balloon is ready for sale at the moment. At the upper and front part of the cabinet 11 is provided a balloon inflating chamber 13. The surrounding wall of the chamber is made of a transparent material. At the front wall of the chamber 13 is provided a door 14, through which a purchaser can take out a balloon. At about the middle of the front wall of the cabinet 11 are provided a coin slot 15 and a switching means 16.

Figure 2:
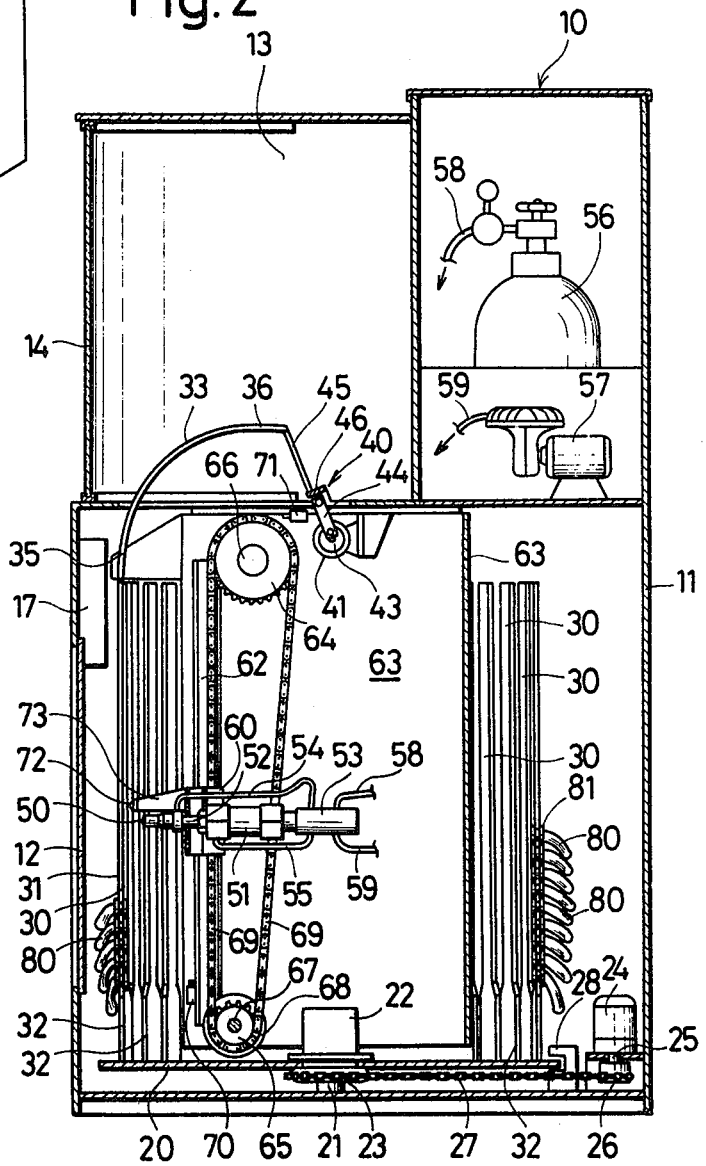
FIG. 2 is an enlarged side view showing cross sectionally the inside structure of the embodiment shown in FIG. 1.

The inside structure of this embodiment is explained in connection with FIG. 2 as follows.

Figure 3:
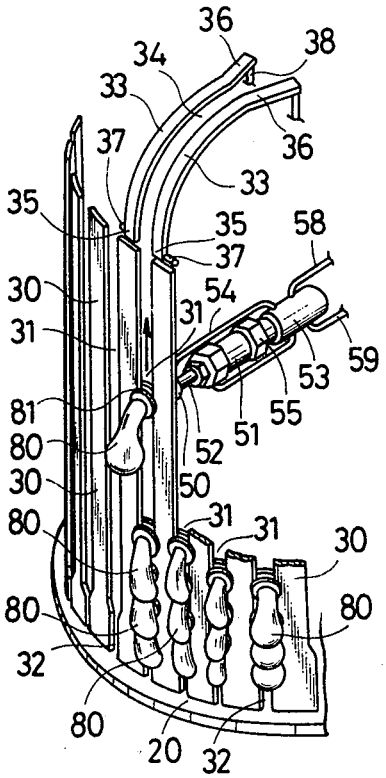
FIG. 3 is a perspective view of the rail means of FIG. 2 being provided with balloons.
Figure 4:
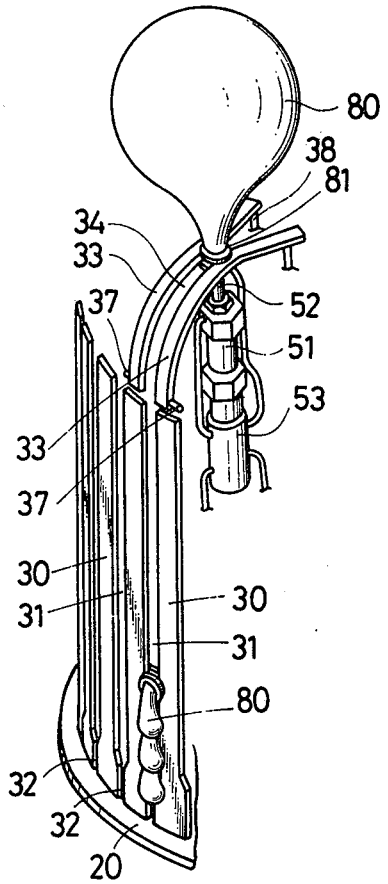
FIG. 4 is a perspective view of the rail means of FIG. 2 with a balloon being inflated.

A disk-like turn table 20 is provided horizontally at a level slightly above the bottom of the cabinet 11, with a shaft 21 projected upright on the bottom and a bearing 22, so that the turn table 20 can rotate horizontally around the shaft 21. To the shaft 21 is fitted a sprocket 23 to rotate along with the turn table 20. To the bottom of the cabinet 11 is equipped an electric motor 24 with another sprocket 26 fitted to the drive shaft 25 of the motor 24. Between the sprocket 23 and the sprocket 26, an endless chain 27 is provided, so the turn table 20 starts to rotate when the electric motor 24 is started. The electric motor 24 includes a speed reduction means and a brake means, and when the motor is switched off it stops the rotation of the turn table 20 instantaneously. Control of the rotation of the turn table 20 is made by use of a position senser 28. For the position senser a photoelectric type is normally employed, however, other type sensers able to sensitively detect a turning angle of the turn table 20 are also usable. On the turn table 20 a number of lower part rails 30 are projected upright. These lower part rails are placed on a circular line, every point of which is the same distance from the center of the turn table 20, that is the center of the shaft 21, with a gap 31 between each two of the rails just wide enough to mount in between the sliding guide part of a balloon neck fitting. As shown in FIG. 3, a number of the balloon neck fittings are mounted in the gap 31, however, each of the balloon neck fittings is mounted therein to slidably engage with the two rails on both sides thereof. The lowest part of each of the lower part rails 30 is made so wide that the fittings cannot enter the narrower gap 32 therebetween. At the upper level above the lower part rails 30 are provided two upper part rails 33, and between the two upper part rails is provided a gap 34 as wide as the gap 31 so that the balloon neck fittings can smoothly slide through the two gaps 31, 34. The upper part rails 33 are not attached to the lower part rails 30, however, the lowest ends of the upper part rails 33 are provided very near the level of the upper ends of the lower part rails 30. Consequently, when the turn table 20 is rotated by a proper angle, the gap 34 can almost perfectly connect with any particular gap 31 for the lower part rails 30.

The upper part rails 33 are curved by 90° in an arc in the middle thereof so as to be substantially vertical at the lower end parts 35 and substantially horizontal at the upper end parts 36. The lower end parts 35 of the upper part rails 33 are supported by pins 37 from outsides, so, the upper part rails 33 can rotate a little around the pins 37 and the upper end parts 36 of the upper part rails 33 can move up and down a liitle. The gap 38 at the upper end parts 36 is made a little wider so that the balloon neck fittings can be easily taken out of the upper part rails by sliding the fittings up to the end parts 36.

A pulling device 40 is fitted to the upper end parts 36. The detailed structure of the device 40 is as follows. A crank mechanism consisting of a disk 43 and a connecting rod 44 is fitted to the drive shaft of the electric motor 41. Whereas, two rods 45 fitted respectively to each rail of the upper end parts 36 of the upper part rails 33 and extending downwards are joined together to make a body at their respective lower ends by means of a connecting member 46. The connecting member 46 and the top end of the connecting rod 44 are engaged with each other by means of a pin. Accordingly, when the electric motor 41 is started, the upper end parts 36 of the upper part rails 33 are pulled downwards, and when the drive shaft of the electric motor 41 rotates by 180° from the position as shown in the FIG. 2, the upper end parts 36 are pulled down to the lowest position, and when the drive shaft rotates by another 180°, the upper end parts 36 are returned to the original position.

Figure 5:
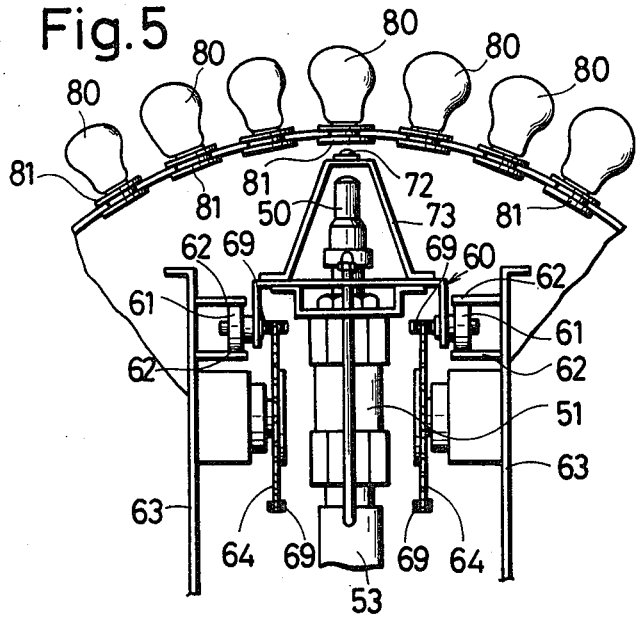
FIG. 5 is a plan view showing the installed state of the gas supplying means of FIG. 4.

A gas supplying nozzle 50 is fitted to the forward end of the piston rod 52 of an air cylinder 51, and the nozzle 50 moves back and forth according to the reciprocating movement of the piston rod 52. At a rear part of the cylinder 51 is provided a solenoid valve 53 which controls the delivery of Helium and/or air into the air cylinder 51 and the gas supplying nozzle 50. For that controlling purpose, the two gas outlets of the valve 53 are respectively connected to the air cylinder 51 and the gas supplying nozzle 50 by means of the gas tubes 54, 55, and the two gas inlets of the valve 53 are respectively connected to a Helium gas bomb 56 and an air compressor 57 by means of the gas tubes 58, 59. A moving device 60 is provided to the air cylinder 51. As shown in the FIG. 2 and the FIG. 5, to the moving device 60 are fitted a few rollers 61 which engage with two guide rails 62 being equipped vertically and parallelly to the lower part rails 30. So, the moving device 60 can move along the guide rails 62. The guide rails 62 are fitted to the inside cabinet 63 which is fixed to the cabinet 11. The guide rails 62 and the inside cabinet 63 are constructed separately from the turn table 20 and the lower part rails 30 and accordingly they do not move even when the turn table 20 and the rails 30 rotate. Upper sprockets 64 are provided near the upper ends of the guide rails 62 and lower sprockets 65 are near the lower ends thereof, and both the sprockets 64, 65 are mounted on the inside cabinet 63 by means of the shafts 66, 67. The shaft 67 for the lower sprockets 65 is directly connected with the drive shaft of an electric motor 68. Between the upper and lower sprockets 64, 65 endless chains 69 are provided, and each one side of the chains 69 is arranged along each of the guide rails 62 and the moving device 60 is fitted to the chains 69. Therefore, when the electric motor 68 is started and the chains 69 move, the moving device 60 moves along the guide rails 62. The electric motor 68 is devised so as to be able to drive in either direction, so, the moving device 60 can be moved up and down as desired. In order to determine the lowest position which the moving device 60 can reach, a limit switch 70 is provided to a proper position of the guide rails 62, which works to stop the motor 68 and the downward movement of the moving device 60 at the time the device 60 gets into contact with the limit switch 70. Whereas, when the moving device moves upwards along the guide rails 62 and reaches the upper ends thereof, the moving device 60 leaves the guide rails 62 and further moves on the chains 69 engaging with the sprockets 64 and finally is directed upright. At that time, the head of the gas supplying nozzle 50 fixed to the moving device 60 moves along an arc line. When the moving device 60 is directed upright, it comes into contact with another limit switch 71 and is stopped thereby at once. Again, when the moving device 60 moves down along the guide rails 62 and comes to the position where a balloon is mounted, the device 60 is managed so as to stop automatically thereat. For that purpose, a senser 72 of reflection photoelectric type for detecting the presence of a balloon is provided to the front end of the moving device 60 by means of an arm rod 73. The type of the senser 72 is not necessarily confined to the reflection photoelectric type, but other type sensers are also usable.

The balloons 80 and the balloon neck fittings 81 thereof are as follows.

Figure 6:
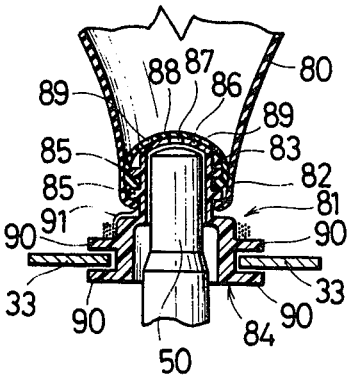
FIG. 6 is an enlarged cross sectional view of the balloon neck fitting just before the fitting is separated.

As shown in FIG. 6, every neck of each of the balloons is provided with a balloon neck fitting 81, which consists of the check valve part 83 to fit into the neck 82 of the balloon and the sliding guide part 84 to engage with both the lower part rails 30 and the upper part rails 33. The check valve part 83 and the sliding guide part 84 are made of material such as plastic and formed in a body but are separable from each other by a small force. For that purpose the connecting part between the check valve part and the sliding guide part is so formed as to be of a thin structure, to have a cut in itself, or the like. On the outer wall surface of the check valve part 83 is formed a small projection 85 lest the check valve part, being put into the neck 82 of a balloon, should leave the neck 82. The check valve part 83 is formed in such a cylindrical shape that the head of the gas supplying nozzle 50 can easily fit thereinto. A gas passage 87 is provided to the center of the top wall 86 of the check valve part 83, and the top wall is provided with a flexible cap 88 with gas passages 89 therein. In this case, the gas passage 87 and the gas passages 89 are respectively located so that they may not coincide with each other. In this way, when the flexible cap 88 tightly fits on to the top wall of the check valve part 83, no gas can pass through both the passages, however, when a gas blows out from the gas supplying nozzle 50 and goes further through the gas passage 87, the flexible cap 88 expands to some extent and the gas can enter the balloon 80 through the gap taking place between the cap 88 and the top wall 86 and through the gas passages 89. When the gas from the gas supplying nozzle 50 stops, the flexible cap 88 contracts and tightly fits again to the top wall 86 and therefore any gas inside the balloon 80 can not leak out through the check valve part 83.

To the sliding guide part 84 of the balloon neck fittings 81 is provided a flange 90 able to slidably engage with the lower part rails 30 and also the upper part rails 33. Thus, the sliding guide part 84 can well slide along the lower and upper part rails without becoming detached therefrom. Between the sliding guide part 84 and the check valve part 83 is provided a connecting string 91 which is to be used for a connecting means for both parts 83, 84 after they are separated into the respective parts. After the sliding guide part 84 is separated from the check valve part 83, the sliding guide part 84 can be taken out of the wider gap part 38 provided at the upper end parts 36 of the upper part rails. Incidentally, the structure of the balloon neck fittings 81 can be properly changed without being limited to the one mentioned above, as a matter of course.

The operation of the embodiment is explained in the following.

Firstly, the balloons 80 are provided in the gaps of the lower part rails 30. Such provision of the balloons is carried out by engaging the sliding guide parts 84 of the balloon neck fittings 81 fitted into the neck 82 of the balloons 80, with the gaps 31 of the lower part rails 30. In this case, a number of the balloon neck fittings 81 with non-inflated balloons are mounted side by side in each gap 31 of the lower part rails 30, filling the gap throughout, and it is preferable if the kind of balloon is made different in each of the gaps.

Figure 10:
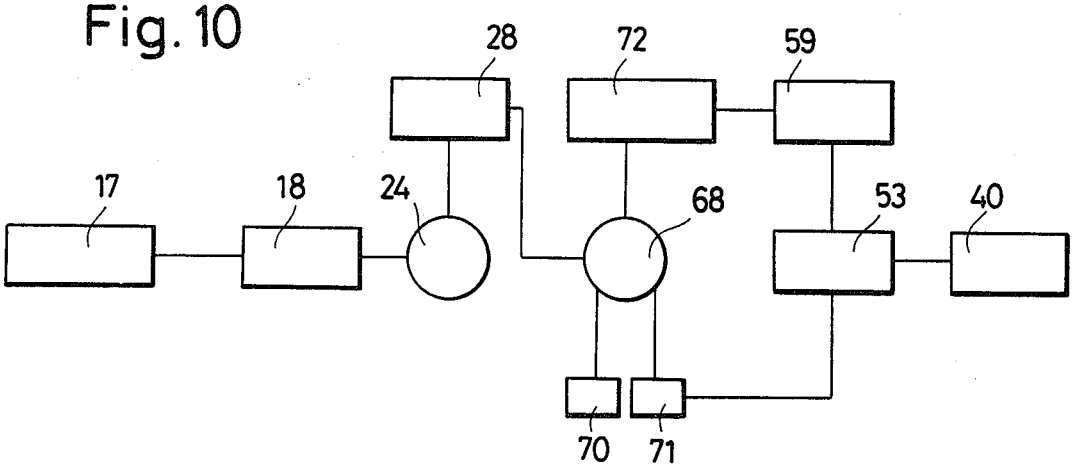
FIG. 10 is a schematic diagram showing the electric system.

In the following, the operation of the balloon vending machine 10 is explained according to the drawings, especially to the FIG. 10. When a coin is put in the coin slot 15, it is sensed by a coin senser 17 and the balloon vending machine 10 becomes ready to serve. When a purchaser operates the switching means 16, the electric motor 24 starts and the turn table 20 begins to rotate slowly. When the particular kind of balloon he wants comes to the right position for taking out, he operates again the switching means 16 and stops the electric motor 24 and the turn table 20 also, peeping inside through the looking glass 12. In this connection, a multi-branch selecting switch system is preferably installed as the switching means 16 in order to automatically control the rotation of the turn table 20. In case such multi-branch selecting switch system is installed, he can automatically bring the balloon he wants to the right position by operating only one switch of the system. Such system is easily installed by using a conventional electric circuit. In the machine, a stopping operation of the turn table 20 is so conducted by the work of the senser 28 that any gap 31 of the lower part rails 30 can perfectly connect with the gap 34 of the upper part rails 33.

Figure 7:
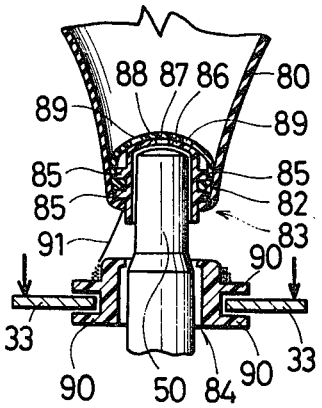
FIG. 7 is an enlarged cross sectional view of the balloon neck fitting just after the fitting is separated.
Figure 8:
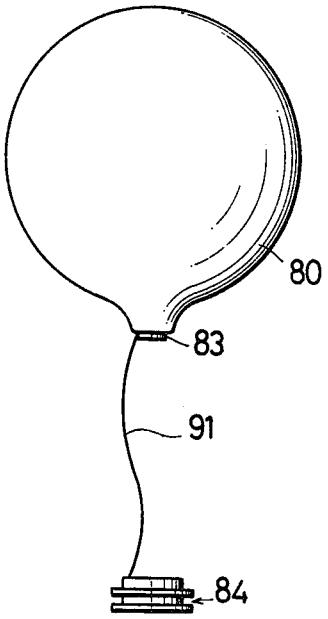
FIG. 8 is a side view showing the balloon being delivered.
Figure 9:
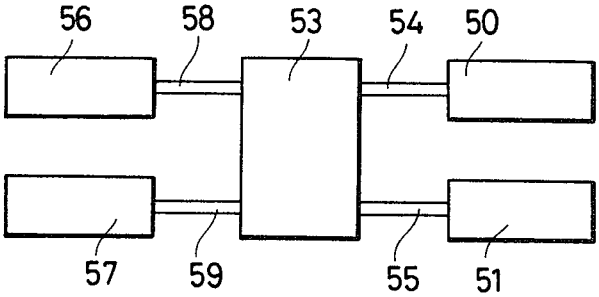
FIG. 9 is a schematic diagram showing the flow of the gas supply.

When the turn table stops rotating, the electric motor 68 starts, the sprockets 65 begin to rotate, the endless chains 69 begin to move, and the moving device 60 begins to come down. The electric motor 68 stops at the position where the senser 72 detects a balloon neck fitting 81 with a balloon 80, and the moving device 60 stops there also. When the moving device 60 stops, the compressor 59 starts and compressed air is transferred to the cylinder 51 via the solenoid valve 53 to make the piston rod 52 move forward. To the piston rod 52 is fitted the gas supplying nozzle 50, so, the nozzle moves forward according to the movement of the piston rod 52 to securely engage with the balloon neck fittings 81 with a balloon 80. Then, the electric motor 68 begins to drive reversely and the moving device 60 starts to move upwards along the rails 62. In this case, as the gas supplying nozzle 50 still remains moved forward, the balloon neck fitting 81 with a balloon 80, which is engaged with the gas supplying nozzle 50, moves upwards along the lower part rails 30 according to the movement of the gas supplying nozzle 50. At the time the moving device 60 goes up to the top ends of the rails 62, the device 60 leaves the rails 62 and begins to turn along with the rotation of the sprockets 64. At this moment, the balloon neck fittings 81 with a balloon 80, too, leaves the lower part rails 30 and begins to slide along the upper part rails 33. When the gas supplying nozzle 50 comes to be directed upright, the limit switch 71 gets into contact with the moving device 60 and stops the driving of the electric motor 68, and thereby the moving device 60 stops moving at the position. Then that solenoid valve 53 operates, and Helium gas from a Helium gas bomb 56 along with or without compressed air from the air compressor 57 is delivered to the gas supplying nozzle 50. When a given quantity of gas from the nozzle 50 is put into the balloon 80 through the balloon neck fittings 81 and the balloon is inflated out with the gas, the solenoid valve 53 works automatically to stop the gas delivery. Then the pulling device 40 works to pull down the upper ends 36 of the upper part rails 33. At that time, the check valve part 83 of the balloon neck fittings 81 still remains pushed upwards by the gas supplying nozzle 50, so, the check valve part 83 can not move down. Accordingly, since the pulling force of the pulling device 40 works at the connecting part between the check valve part 83 and the sliding guide part 84, the sliding guide part 84 is cut off the check valve part 83 as shown in the FIG. 7. Then the inflated out balloon 80 hovers carrying the check valve part 83 with it and being connected by the connecting string 91 with the sliding guide part 84 which still remains on the upper part rails 33. Further then, the solenoid valve 53 works to move the piston rod 52 backwards and causes the gas supplying nozzle 50 to leave the check valve part 83 of the balloon neck fittings 81. Therefore, the purchaser can take the balloon 80 out of the cabinet 11 by taking the sliding guide part 84 out of the upper part rails 33 through sliding the sliding guide part 84 up to the upper end parts 36 of the upper part rails 33, after opening the door 14 of the cabinet 11. Since a connecting string is present between the check valve part 83 and the sliding guide part 84, the balloon 80 does not hover higher than the length of the string 91. The sliding guide part 84 is shaped like a ring in itself, therefore, it can be used as a hook for the finger. After one cycle of the balloon vending process finishes in such manner, the balloon vending machine 10 becomes ready for the next cycle.

The above-mentioned embodiment is merely intended to explain in detail the present invention and is not to be construed to limit the scope of the present invention, and it allows, as a matter of course, some alterations within the scope of the mentioned in the following claims.

What is claimed is:

1. A balloon vending machine comprising:

a rotatable turntable and means for rotating said turntable about a central axis;

a plurality of pairs of rails projecting from said turntable at equal distances from said central axis, each pair of rails defining a respective first gap which slideably receives a plurality of neck fittings of unfilled balloons and, upon rotation of said turntable, stops at a given position;

fixed rail means positioned adjacent said given position in close proximity to said plurality of pairs of rails and defining a second gap in alignment with each said first gap when in said given position and which can slideably receive individual neck fittings of balloons, said fixed rail means having an end portion remote from said first gaps;

gas supplying means positioned radially inwardly from said plurality of pairs of rails, said gas supplying means including nozzle means positioned for radial movement toward each said first gap when in said given position for entering an individual neck fitting of a balloon;

means coupled to said gas supplying means for selectively moving said nozzle means into a neck fitting of a balloon;

means coupled to said gas supplying means for moving said nozzle means parallel to said plurality of pairs of rails and said fixed rail means to a filling station thus moving said neck fitting with a balloon attached from a pair of rails at said given position onto said fixed rail means to said filling station;

means responsive to arrival of a balloon in said filling station for triggering said nozzle means to inflate that balloon; and pulling means coupled to said end portion of said fixed rail means for pulling said end portion to aid in separating into two parts the neck fitting of that balloon which has been inflated.

2. A balloon vending machine as defined in claim 1, including a cabinet, a switch means on said cabinet, and wherein said means for rotating said turntable comprises an electric motor in circuit with said switch means.

3. A balloon vending machine as defined in claim 1, wherein said pluralities of pairs of rails are arranged on a circular line concentric with said turntable and project upwardly, said first gap being just wide enough to receive a reduced central portion of a balloon neck fitting.

4. A balloon vending machine as defined in claim 1, including sensing means for sensing the angular position of said turntable, and means responsive to said sensing means for controlling said means for rotating said turntable to align individual ones of said first gaps with said second gap.

5. A balloon vending machine as defined in claim 1, wherein each of said balloon neck fittings consists of a check valve portion and a sliding guide portion and becomes separated into these two portions when said guide portion is pulled by said pulling means against a holding force caused by presence of nozzle means of said gas supplying means in said check valve part where it has become positioned by action of said means for moving said nozzle means into a neck fitting.

6. A balloon vending machine as defined in claim 1, wherein said nozzle means of said gas supplying means fits into a balloon neck fitting after being moved thereto by said means for moving said nozzle means into said neck fitting.

7. A balloon vending machine as defined in claim 6, including a sensor provided in said filling station in proximity to the position of said gas supplying means in said station for stopping movement of said gas supplying means at a position where the presence of a balloon neck fitting is sensed, a portion of said gas supplying means fitting into a balloon neck fitting after the movement of said gas supplying means stops.

8. A balloon vending machine as defined in claim 6, wherein means to cause a portion of said gas supplying means to fit in a balloon neck fitting is constituted of an air cylinder and accessories thereof, and wherein said means to move said nozzle means parallel to said plurality of pairs of rails and said fixed rail means is constituted of an endless chain, two sprockets and a driving means coupled to one of said two sprockets.

* * * * *